US006263578B1

(12) United States Patent
Frantz et al.

(10) Patent No.: US 6,263,578 B1
(45) Date of Patent: Jul. 24, 2001

(54) ERGONOMIC GRIDDLE SCRAPING TOOL

(75) Inventors: Howard Jay Frantz, Irvine; Christopher Paul Lojacono, Laguna Niguel, both of CA (US)

(73) Assignee: In-N-Out Burgers, Irvine, CA (US)

( * ) Notice: Subject to any disclaimer, the term of this patent is extended or adjusted under 35 U.S.C. 154(b) by 0 days.

(21) Appl. No.: 09/405,963

(22) Filed: Sep. 27, 1999

(51) Int. Cl.[7] ..... B26B 3/00
(52) U.S. Cl. ..... 30/169; 30/491
(58) Field of Search ..... 30/169, 491; 15/143.1

(56) References Cited

U.S. PATENT DOCUMENTS

| | | | | |
|---|---|---|---|---|
| 274,600 | * | 3/1883 | Hegglund | 30/169 |
| D. 312,520 | | 11/1990 | Wilson . | |
| D. 362,937 | | 10/1995 | Camp et al. . | |
| 1,100,770 | * | 6/1914 | Page | 30/169 |
| 1,645,781 | * | 10/1927 | Szako | 30/169 |
| 3,068,921 | * | 12/1962 | Paolicelli | 30/169 |
| 3,530,577 | * | 9/1970 | Franklin et al. | 30/491 |
| 4,040,140 | | 8/1977 | Hopkins et al. . | |
| 4,091,579 | | 5/1978 | Gianglulio . | |
| 4,182,000 | * | 1/1980 | Fairbairn | 30/169 |
| 4,890,351 | | 1/1990 | Wilson . | |
| 4,962,561 | * | 10/1990 | Hamilton | 15/143.1 |
| 5,440,811 | | 8/1995 | Challis . | |
| 5,455,981 | | 10/1995 | Weise . | |
| 5,471,700 | * | 12/1995 | Pereira | 15/143.1 |
| 5,694,696 | * | 12/1997 | Lee et al. | 30/169 |
| 5,706,553 | | 1/1998 | Riley et al. . | |
| 5,709,596 | * | 1/1998 | Alexander et al. | 15/143.1 |
| 5,720,071 | | 2/1998 | Hall . | |
| 5,758,983 | | 6/1998 | Thomas . | |
| 6,018,841 | * | 2/2000 | Kelsay et al. | 15/143.1 |

* cited by examiner

*Primary Examiner*—M. Rachuba
(74) *Attorney, Agent, or Firm*—Edward O. Ansell

(57) ABSTRACT

An ergonomically-designed, operator manipulated scraper means for contacting a cooking surface for the purpose of dislodging and/or removing unwanted material therefrom. A griddle scraper has a platform member, the downwardly distending forward portion of which comprises a cleaning means terminating in a blade edge, and the rear portion of which extends in an upwardly direction. A support member connects at its lower end to said platform and extends upwardly, having a rearwardly inclined end portion. A "handshake grip" handle positioned above said platform interconnects the support member to said upwardly extending rear portion of said platform. A knob handle is mounted on the support member upper end. In operation, the operator positions the blade edge to engage the griddle surface, the platform being elevated above the grill in a non-touching relationship, the scraper is moved in a forward direction by exertion of normal force by the operator on both the grip handle and the knob until static friction is overcome, after which the device continues in a gliding motion propelled by tangential force as the rear portion of the platform descends downwardly until in substantially touching relationship to the griddle surface, during which motion the operator removes one hand from the knob, and the device is guided by the remaining hand on the handle until it reaches the end of its travel, whereby the cleaning operation is completed.

6 Claims, 5 Drawing Sheets

ERGONOMIC GRIDDLE SCRAPING TOOL

CROSS-REFERENCE TO RELATED INVENTIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to an ergonomically-advantaged tool for cleaning griddle cooking surfaces, particularly where frequent and regular build-up of debris is encountered, minimizing repetitive motion injuries which frequently result from high frequency, extended duration use of the cleaning tools of the prior art.

According to the Occupational Safety and Health Administration (OSHA) of the US Department of Labor, substantial sound scientific evidence links musculoskeletal disorders to work. The scientific literature demonstrates that workers who face high biomechanical stress—such as heavy lifting and repetitive motion—have high rates of work-related musculoskeletal disorder (WMSDs) such as back injuries, tendinitis and carpal tunnel syndrome. Most people face their main exposures to physical stress on their jobs. The National Academy of Sciences has found "compelling evidence" that reducing biomechanical stress on the job reduces the risk of injuries. Literature reviews and studies provide extensive scientific verification that musculoskeletal disorders are linked to work, and that workplace interventions can reduce the risk of injury of workers.

Fast-food preparation utilizing griddles requires frequent and regular removal of cooking residue to keep the cooking surface clear. Traditionally, a putty knife style scraping tool is repetitively moved across the cooking surface as often as 50 times per hour, depending upon the quantity of items in preparation. Over a period of time, this can become a contributing factor to repetitive motion injuries, sometimes requiring surgery and/or rehabilitation therapy.

The physical stress experienced by the scraper operator is attributable to friction and is directly related to the amount of force required to be applied by the operator to maintain the leading edge of the scraper tool in touching relationship to the griddle as the scraper is urged forward to overcome static friction, and thereafter encountering sliding friction, glide the tool along the cooking surface to the end of its forward travel, pushing aside cooking residue in its path as it travels.

Friction is the universal force between surfaces that opposes sliding motion. When surfaces of two bodies are in contact, the interactive force at the surface may have components both perpendicular and tangent to the surface. The perpendicular component is called the normal force, and the tangential component is called the friction force. If there is relative sliding at the surface, the friction force always acts in the opposite direction of this motion.

Most dry surfaces behave approximately according to Coulomb's friction law, which states that, approximately and within limits, (1) the friction between two surfaces is slightly greater just before motion begins than when the surfaces are in steady relative motion, that is, the force required to overcome static friction is usually greater than the force needed to sustain uniform sliding motion; and (2) when the surfaces slide relative to one another, the friction force is proportional to the normal force and is independent of both the contact area and the speed of sliding. The ratio of the tangential force to the normal force during sliding is called the coefficient of friction and depends on the nature of the two surfaces. In order to initiate sliding against friction, it is necessary to apply a tangential force at least as great as the product of the coefficient of friction and the normal force. Before the onset of motion, the force is resisted by the equal and opposite force of static friction.

It is a requirement for efficient scraping that prior art griddle scrapers be held at an angle to the surface to be scraped, with the scraping edge in contact therewith, and simultaneously be urged in a direction parallel to the surface. The design of most prior art scrapers requires the simultaneous application of the required forces, a significant factor contributing to repetitive motion injuries. Past efforts to address this problem have resulted in griddle scrapers which were too large, heavy, clumsy and difficult to use in a space-restricted work station.

BRIEF DESCRIPTION OF PRIOR ART

U.S. Pat. No. 4,040,140 shows a scraper adapted to be held in the hand of a user with a downwardly curved blade section facilitating the application of force longitudinally of a surface to be scraped with the hand of the user remaining spaced from that surface, while the material to be scraped is deflected substantially from the hand of the user. Affording no means adapted for sequential application of differential normal and tangential forces, the design of this device provides little, if any, relief from repetitive motion injury resulting from high frequency, extended duration repetitive motion.

U.S. Pat. No. 5,440,811 shows a hand tool for scraping across a work surface. While the scraping blade has a plurality of scraping edges, this is a conventional, single handle scraping tool and the design thereof, being similarly deficient, contributes nothing to alleviating the problem solved by the applicant's invention.

U.S. Pat. No. 4,890,351 and companion U.S. Design Pat. No. 312,520 disclose griddle scrapers with a single handgrip and forwardly and downwardly projecting blades. A guard is spaced from the underside of the handgrip to afford protection to the operator's fingers and serves as a stable base. An upwardly extending protective shield is mounted on the blade. Again, the single handle means affords no relief from repetitive motion injury, nor is the need for an economic approach recognized.

U.S. Pat. No. 5,455,981 addresses the need to minimize arm fatigue and cramping due to scraping motion. Support of the user's forearm in conjunction with a cylindrical handle that extends substantially perpendicular to the scraper blade allegedly extends the period of time that the tool can be used without fatiguing the operator's arm. This structure falls short of measures required to minimize repetitive motion injury incurred as the result of high frequency, extended duration, repetitive motion because it too affords no means adapted for sequential application of differential normal and tangential propulsion forces.

U.S. Pat. No. 5,758,983 relates to an Ergonomically Correct and Economically Efficient Handhold Scraper. However, being designed for ice removal, other than providing an ergonomically-advantaged gripping means, the design has little relevance to scraping means adapted to remove cooking residue from a griddle surface.

U.S. Pat. No. 4,091,579 relates to a combination griddle and griddle scraper which contemplates a continuous two-handed application of force to the device through a grasping handle and placement of the user's second hand upon an intermediate portion of the scraper which terminates in a blade, brush or abrasive stone. However, the structure of the device, the multiplicity of applications, and the necessarily resultant complexity and size precludes realization of compactness, lightness in weight and maneuverability, mandatory attributes for a tool to be used in tight work stations, features found in the present invention. Nor is attention directed to economic factors minimizing repetitive motion injury resulting from high frequency, extended duration scraping efforts by affording means for sequential application of differential normal and tangential forces, a feature of the present invention.

U.S. Design Pat. No. 362,937 discloses a scraper handle having a hand-grasping portion which encircles a user's hand and a knob, each mounted on a common plane with a blade. While aesthetically pleasing, the structure appears to require an awkward, two-handed inclination of the blade to the surface to be scraped, and a continuous, fatiguing, two-handed application of force throughout the scraping cycle, affording no means adapted to provide sequential application of differential normal and tangential forces of differential magnitude.

It is therefore the principal object of the present invention to provide an economic means of removing residue from a cooking surface of a griddle, which will reduce the occurrence of WMSDs, including repetitive motion injuries to the wrist, shoulder, and back of the user.

It is another object to provide a maneuverable and compact cleaning tool of the type described for use at cooking stations where space is limited.

BRIEF SUMMARY OF THE INVENTION

An ergonomically-designed, operator manipulated scraper means for contacting a cooking surface for the purpose of dislodging and/or removing unwanted material therefrom. A griddle scraper has a platform member, the downwardly distending forward portion of which comprises a cleaning means terminating in a blade edge, and the rear portion of which extends in an upwardly direction. A support member connects at its lower end to said platform and extends upwardly, having a rearwardly inclined end portion. A "handshake grip" handle positioned above said platform interconnects the support member to said upwardly extending rear portion of said platform. A knob handle is mounted on the support member upper end. In operation, the operator positions the blade edge to engage the griddle surface, the platform being elevated above the griddle in a non-touching relationship. The scraper is moved in a forward direction by exertion of a normal force by the operator on both the grip handle and the knob until static friction is overcome, after which the device continues in a gliding motion propelled by tangential force as the rear portion of the platform descends downwardly until in substantially touching relationship to the griddle surface, during which motion the operator removes one hand from the knob, and the device is guided by the remaining hand on the handle until it reaches the end of its travel, whereby the cleaning operation is completed.

DETAILED DESCRIPTION OF THE INVENTION

Figure 1:
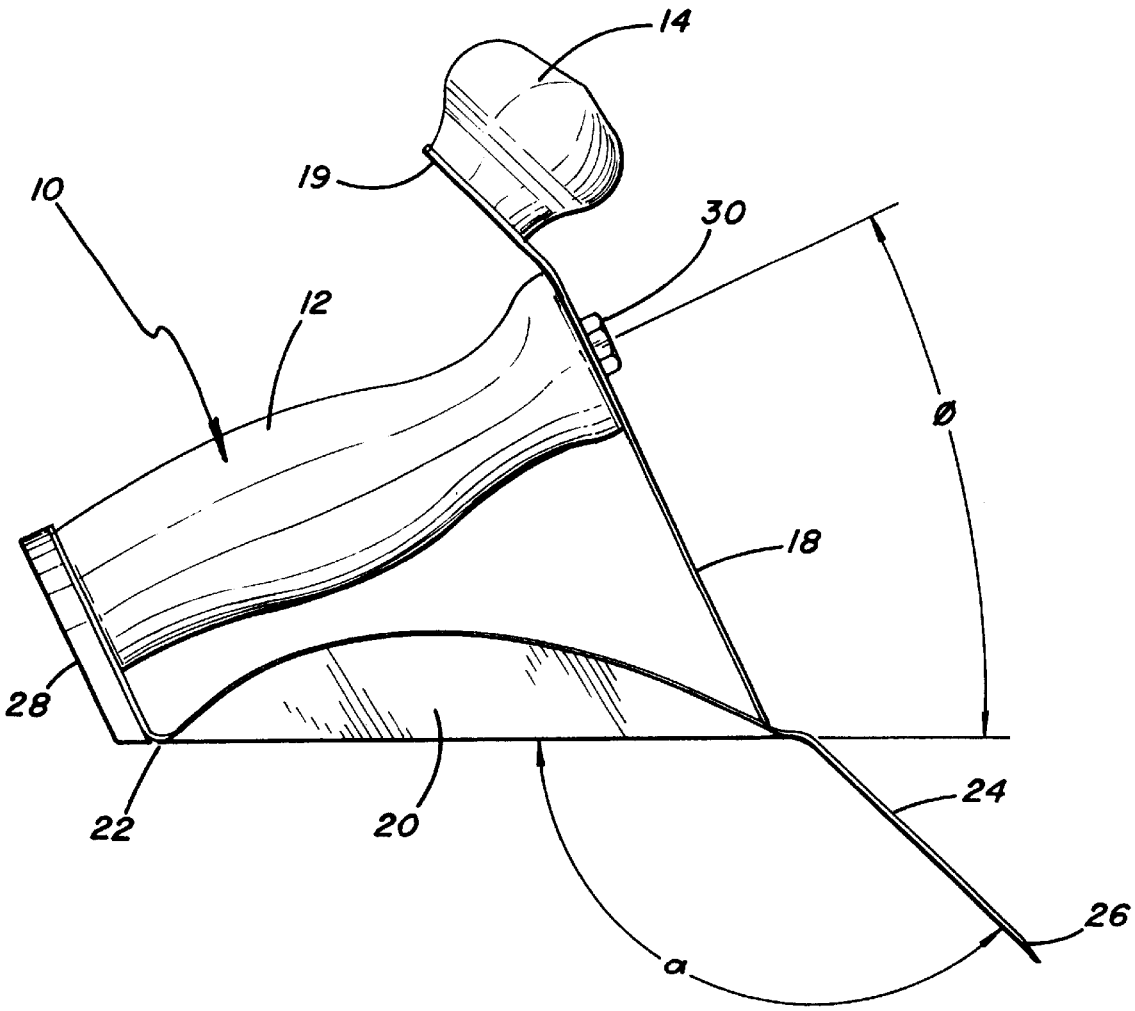
FIG. 1 is a side plan view of the economic griddle scraper of the present invention.
Figure 2:
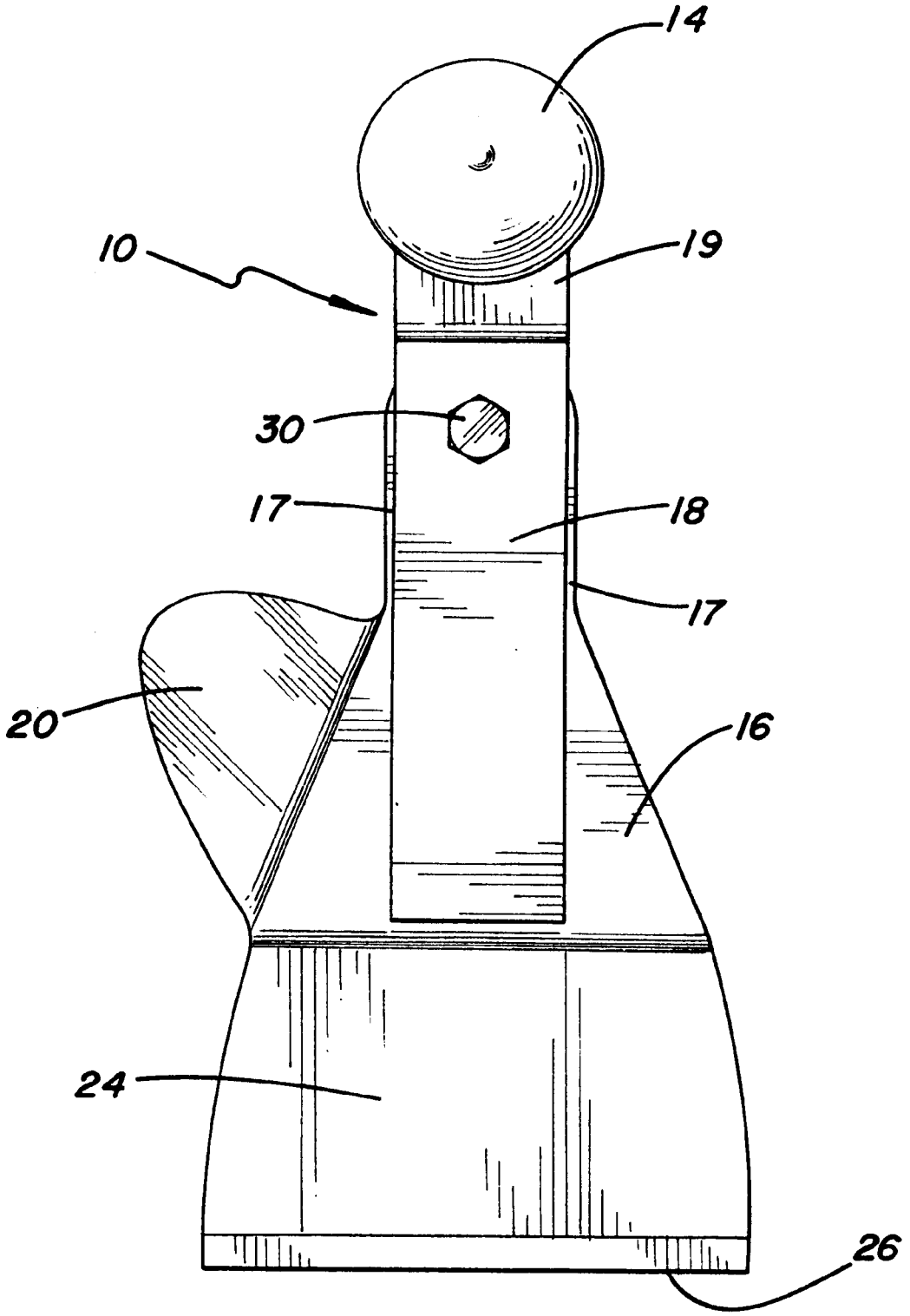
FIG. 2 is an end view of the scraper embodying the invention.
Figure 3:
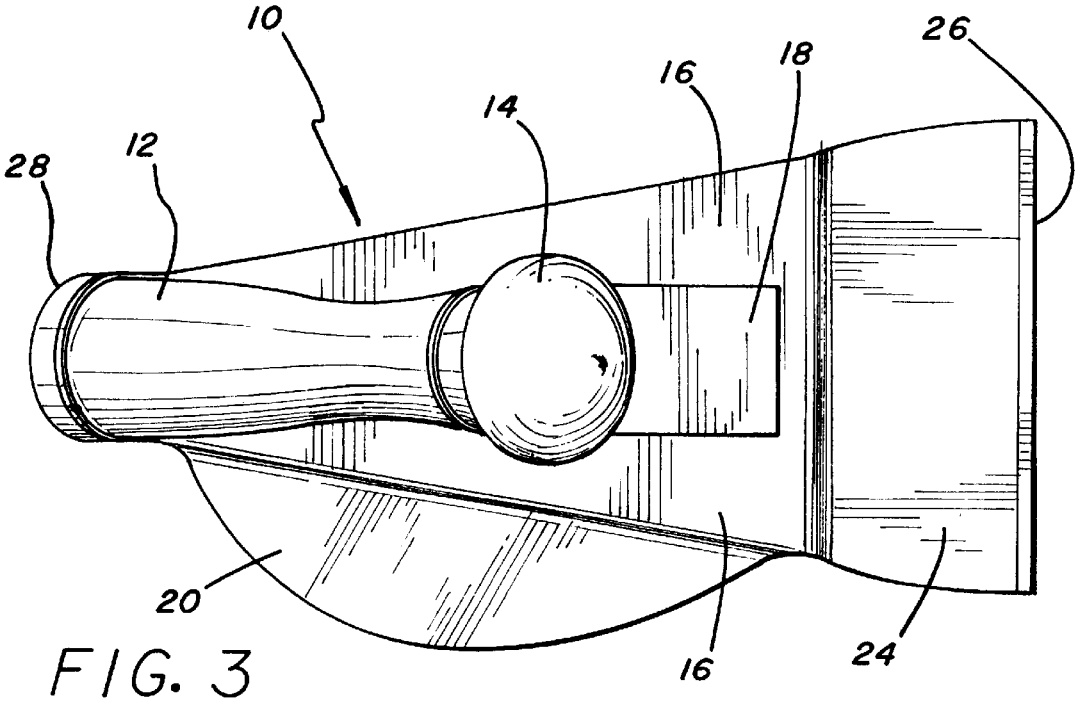
FIG. 3 is a top view of the griddle scraper shown in FIGS. 1. and 2.
Figure 4:
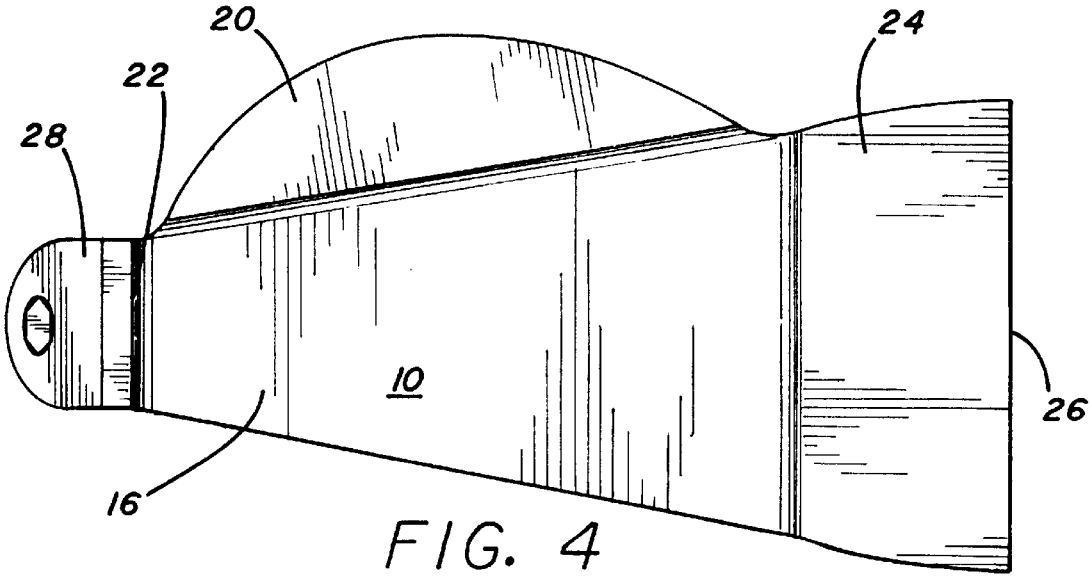
FIG. 4 is a bottom plan view of the griddle scraper of the foregoing figures.

Referring to the drawings FIGS. 1–4 show an improved griddle scraping tool which combines compactness and maneuverability and which minimizes the possibility of repetitive motion injuries to an operator's wrist, shoulder or back. The invention comprises a griddle scraper 10 having a grease guard platform member 16, the forward portion of which has a downwardly distending portion defining a scraper blade 24 terminating in a blade edge 26, the blade member 24 distending at an angle a substantially equal to 135°. The rear portion of said platform inclines to form an upwardly extending rear portion 17, the juncture of the inclination being hereafter referred to as a gliding heel 22. A support member 18 connects at its lower end to the forward portion of said platform member 16, extending upwardly then inclining rearwardly to terminate in an end-portion 19. A handle 12, suitable for grasping by an operator's hand, interconnects the support member 18 to said upwardly extending rear portion 17 of said platform 16 by a fastening means 30 at an angle ø of substantially 25° to 35° from the plane of the platform 16. Although fastening means in the form of a bolt is shown in the drawings, other means of securing the handle 12 to the support member 18 may be employed. An outwardly facing knob handle 14, adapted to be grasped by the operator's other hand, is mounted on the rearwardly inclined end-portion 19 of said support member 18. A wing member 20, attached to a lateral edge of said platform 16, affords additional protection to the hand knuckles of the scraper operator against any encounter with hot cooking residue which may be pushed upwardly during use of the device 10. An optional feature is a back-connector 28 through which the fastening means 30 could extend. When the appropriate material is employed, this also may act as an insulator in the event of operator contact with the rear of the tool 10 which may be at an elevated temperature.

We have found that combination of the "handshake" handle 12 in the described attitudinal relationship to the plane of the grease guard platform member 16, and the knob handle 14, mounted on the rearwardly inclined portion 19 of the support member, and the described attitudinal relationship of the blade member 24 to the plane of said platform member 16, affords a means for sequential application of normal force sufficient to overcome the static friction of the blade member 24 against a griddle surface and application thereafter of a tangential force of a lesser but sufficient magnitude to overcome the sliding friction of the blade member 24, as it travels in a forward direction in optimum contacting relation with a griddle surface.

Figure 5A:
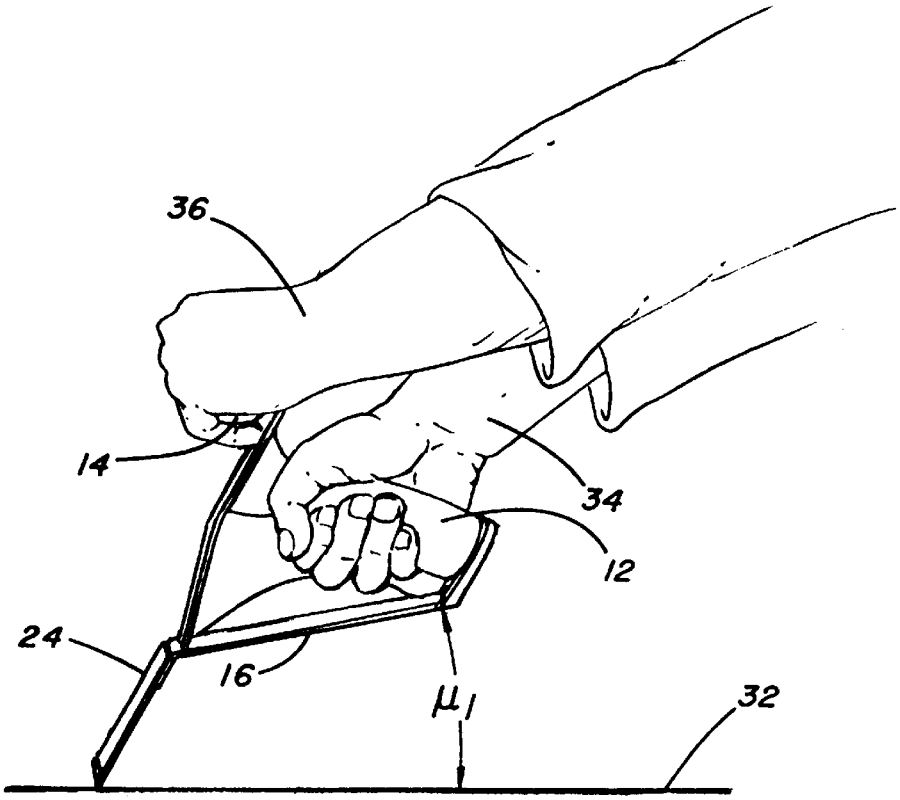
FIG. 5*a* illustrates the initial position of the device of the present invention as it is positioned to move forward.
Figure 5B:
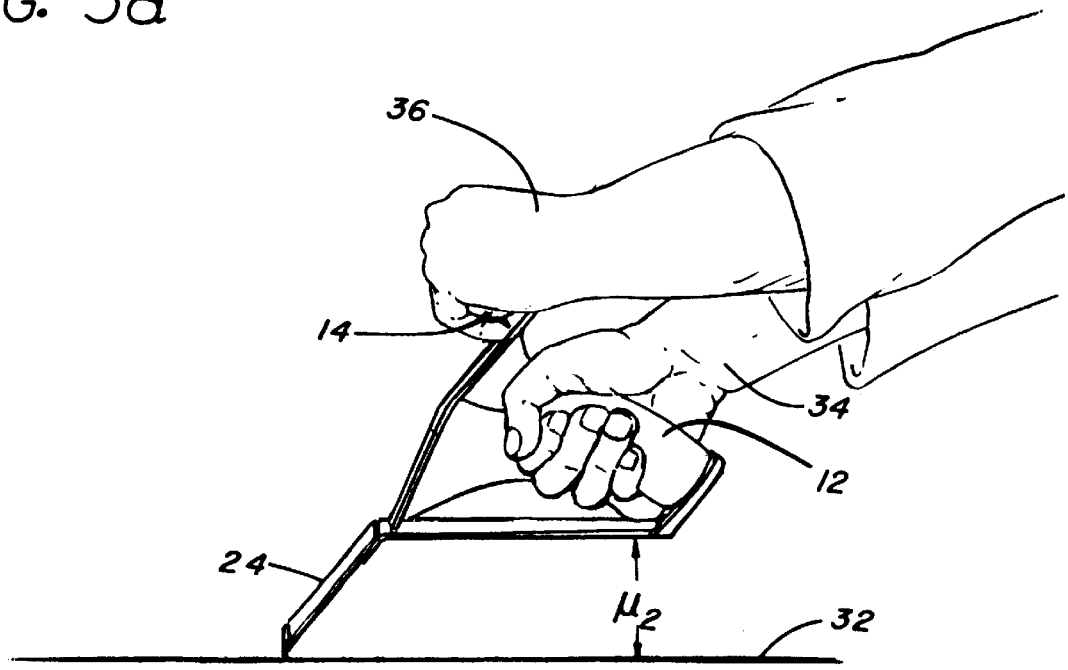
FIG. 5*b* shows the tool with relation to the griddle cleaning surface after static friction has been overcome.
Figure 5C:
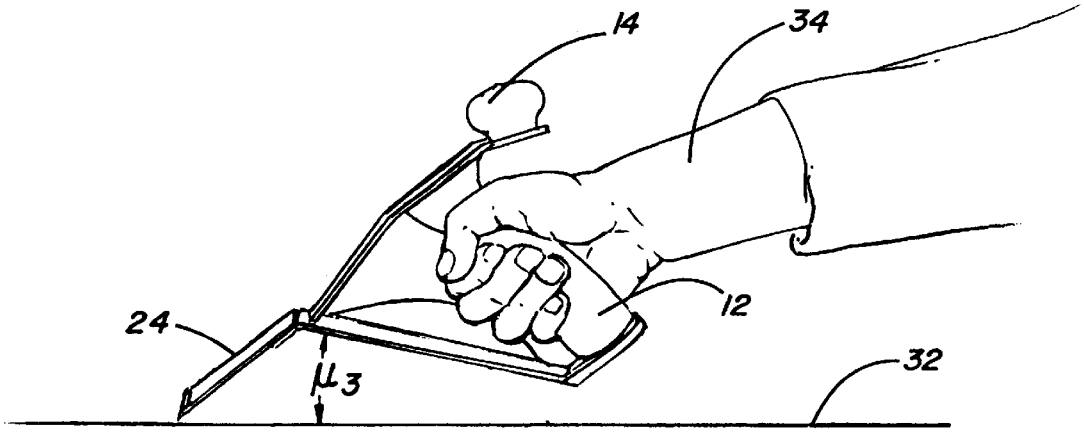
FIG. 5*c* shows the relationship of the tool to the griddle surface as it glides forward.
Figure 5D:
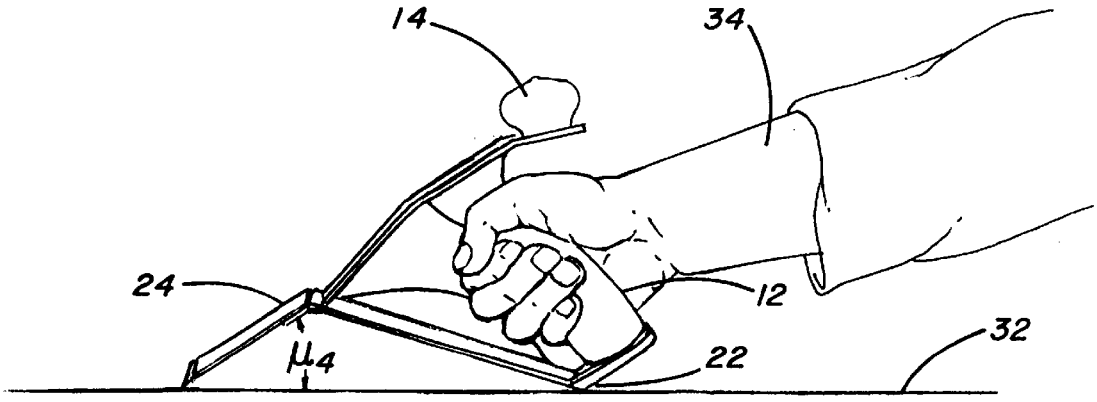
FIG. 5*d* shows the relative position of the tool with respect to the griddle surface at the termination of its forward travel path.

The use of this device 10, as illustrated in FIGS. 5*a*–5*d*, is initiated by the operator grasping the handshake handle 12 with a first hand 34 and the knob 14 with the other hand 36, initially orienting the blade member 24 against the griddle surface 32 to be cleaned (see FIG. 5*a*). To commence the scraping operation the operator grasps the handshake handle 12 with one hand 34 and the knob 14 with the other 36. The blade surface 24 engages the griddle surface 32 by application of a normal (downward) force upon the handle 12, the platform member 16 being elevated from the griddle surface 32 at an angle $\mu_1$ dependent upon the positioning of the blade 24 with respect to the griddle surface 32, but generally elevated above the horizontal. Forward motion of the tool 10 commences along the griddle surface 32, once initial starting friction is overcome, by application of force from the operator's hands 34, 36 to the handles 12, 14 as shown in FIG. 5*b,* the platform member 16 gradually descending to form a lesser angle $\mu_2$, as the tool 10 glides along in a forward direction. FIG. 5*c* illustrates the position of the tool 10 at a subsequent stage of the scraping motion, forward travel being imparted by application of a tangential force, less than said normal force, exerted to overcome sliding friction by a single operator's hand 34 on the hand-shake grip handle 12. The orientation of the tool $\mu_3$, as measured by the elevation of the platform with respect to the griddle surface, lessens as it moves further along in a forward direction. As shown in FIG. 5*d,* the one-handed forward motion of the scraper 10 continues, the gliding heel 22 of the platform 16 contacting the griddle surface 32 as the scraper 10 continues until the end of its travel path. The orientation of the blade against the griddle surface 32 is dependent upon the amount of debris to be cleared, the optimum orientation being about 60° at commencement of the scraping operation and about 30° at the end of the stroke. If the angle is too large it becomes difficult to initiate forward motion. If the angle is too shallow, the efficacy of the cleaning function is diminished.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

We claim:

1. An operator-propelled ergonomic griddle cleaning device comprising:

(a) grease guard platform having an upwardly extending rear portion and a downwardly extending forward portion terminating in cleaning means adapted to engage, in touching relationship, the surface to be cleaned;

(b) an upwardly extending support member connected at its lower end to said platform at its forward portion, said support member including a rearwardly inclined upper end portion;

(c) a first "handshake grip" handle, adapted to be grasped by an operator, interconnecting said upwardly extending support member and said platform rear portion; and (d) a second knob handle mounted on said rearwardly-inclined upper end portion, whereby a normal force sufficient to overcome the static friction resulting from engagement of the cleaning means to the surface to be cleaned may initially be applied to said first and second handles, and a tangential force of lesser intensity than said normal force, but sufficient to overcome the sliding friction of engagement of the blade means with said surface means, may be applied to said second handle.

2. A cleaning device as set forth in claim 1, wherein the included angle between the plane of said platform member and the central axis of said grip handle is substantially equal to 25° to 35°.

3. A griddle cleaning device as set forth in claim 1, wherein said cleaning means comprises a scraper blade extending downwardly from said platform member at an angle substantially equal to 135°.

4. A griddle cleaning device as set forth in claim 1, wherein said knob is mounted on the frontal outer surface of said rearwardly inclined portion of said support member upper end.

5. A griddle cleaning device as set forth in claim 1, wherein a curved wing member is attached to a lateral edge of said grease guard.

6. An operator-propelled ergonomic griddle cleaning device comprising:

(a) a grease guard platform having an upwardly extending rear portion and a downwardly extending forward portion terminating in cleaning means adapted to engage, in touching relationship, the surface to be cleaned, said forward portion being positioned from said platform member surface at an angle substantially equal to 135°;

(b) an upwardly extending support member connected at its lower end to said platform at its forward portion, said support member including a rearwardly inclined upper end portion;

(c) a first "handshake grip" handle, adapeted to be grasped by an operator, interconnecting said upwardly extending support member from below its rearwardly inclined upper end portion to said upwardly extending rear portion, said handle being positioned to form an included angle between the plane of said platform member and the central axis of said handle substantially equal to 25° to 35°; and (d) a second knob handle mounted on the frontal surface of said rearwardly-inclined support member upper end portion, whereby a normal force sufficient to overcome the static friction resulting from engagement of the cleaning means to the surface to be cleaned may initially be applied to said first and second handles, and a tangential force of lesser intensity than said normal force, but sufficient to overcome the sliding friction of engagement of the blade means with said surface means, may be applied to said second handle.

* * * * *